United States Patent [19]

Kuno et al.

[11] Patent Number: 4,847,656

[45] Date of Patent: Jul. 11, 1989

[54] METHOD AND APPARATUS FOR CONTROLLING COPYING OPERATION

[75] Inventors: Masashi Kuno; Akira Hirose, both of Tokyo, Japan

[73] Assignee: Ricoh Company, Ltd., Tokyo, Japan

[21] Appl. No.: 182,236

[22] Filed: Apr. 15, 1988

[30] Foreign Application Priority Data

Apr. 16, 1987 [JP] Japan ..... 62-57717[U]

[51] Int. Cl.[4] ..... G03G 21/00

[52] U.S. Cl. ..... 355/202; 355/77; 355/313

[58] Field of Search ..... 355/6, 14 R, 14 SH, 355/3 SH, 3 R, 133, 77

[56] References Cited

U.S. PATENT DOCUMENTS

| | | | |
|---|---|---|---|
| 4,126,390 | 11/1978 | Connin | 355/6 |
| 4,248,528 | 2/1981 | Sahay | 355/6 |
| 4,716,438 | 12/1987 | Farrell | 355/6 |
| 4,757,348 | 7/1988 | Rourke et al. | 355/6 |

*Primary Examiner*—R. L. Moses

*Attorney, Agent, or Firm*—Oblon, Spivak, McClelland, Maier & Neustadt

[57] ABSTRACT

A method and apparatus for controlling copying operation modes of a copier having a paper feeding device. In a data sheet information of a desired copying operation mode is inputted in advance. The data sheet is first fed to a copying section in the copier before original papers and the information is detected. The following original papers are processed under the desired copying operation mode designated by the information in the data sheet.

10 Claims, 5 Drawing Sheets

METHOD AND APPARATUS FOR CONTROLLING COPYING OPERATION

BACKGROUND OF THE INVENTION

The present invention relates to a method and apparatus for controlling copying operation modes of a copying machine. More particularly, the present invention relates to the copying machine which can carry out various modes of the copying operation and has an original paper feeding device for sequentially feeding a plurality of original papers to a document table of the copying machine.

Recent copying machines (copiers) are provided with an automatic original paper feeding device (automatic document feeder) which is capable of sequentially and automatically feeding a plurality of original papers to a document table in the copying machine.

The conventional copying machines, however, has a disadvantage that it produces only a time-consuming and inefficient operation because once the various copying conditions such as size of original, number of originals, ratio of copy magnification, choice between single-faced and double-faced modes, and aftertreating modes of stapling and perforating works are set, they are not allowed to be changed until the copying operation of the mode determined by the copying conditions is completed.

SUMMARY OF THE INVENTION

It is, therefore, an object of the present invention to provide a method and apparatus for controlling copying operation modes of a copying machine, whereby a copying operation mode for a plurality of original papers to be copied can be set in the copying machine in a very short time.

Another object of the present invention is to provide a method and apparatus for controlling copying operation modes of a copying machine, whereby copying operation modes for a plurality of original papers to be copied can be freely changed even during copying operation.

According to the present invention, the above-mentioned objects can be attained by a method of controlling copying operation modes of a copying machine provided with a copying means for performing a copying operation and a feeding means for sequentially feeding a plurality of original papers to the copying means, the copying machine being able to carry out a plurality of copying operation modes, the method comprising the steps of inputting information of a desired copying operation mode in a data sheet; arranging the data sheet at the forefront of the original papers in the feeding means so that the data sheet is first fed to the copying means, the above-mentioned original papers being to be processed under the desired copying operation mode; detecting information in the data sheet; and in response to the information detected from the data sheet, selectively carrying out a copying operation of the desired copying operation mode with regard to the original papers following the data sheet.

The above-mentioned objects can be also attained by an apparatus for controlling copying operation modes of a copying machine provided with a copying means for performing a copying operation and a feeding means for sequentially feeding a plurality of original papers to the copying means, the copying machine being able to carry out a plurality of copying operation modes, the apparatus comprising; a first means for detecting information inputted in a data sheet which is fed to the copying means before a plurality of the original papers; and a second means for, in response to the information detected from the data sheet, selectively carrying out a copying operation of a desired copying operation mode which is designated by the detected information, the copying operation being carried out with regard to the original papers following the data sheet.

According to the present invention as described above, when the copying machine is ready for starting a copying operation, information inputted in advance in the data sheet is detected and a copying operation determined by the detected information from the data sheet is sequentially executed in a fixed order. Thus, a copying operation mode for a plurality of original papers to be copied can be set in the copying machine in a very short time, and copying operation modes for a plurality of original papers to be copied can be freely changed even during copying operation. Therefore, the inevitable waiting time can be eliminated and the efficiency of the copying operation can be improved.

Further objects and advantages of the present invention will be apparent from the following description, reference being had to the accompanying drawings wherein preferred embodiments of the present invention are clearly shown.

DETAILED DESCRIPTION OF THE PREFERRED EMBODIMENTS

Figure 1:
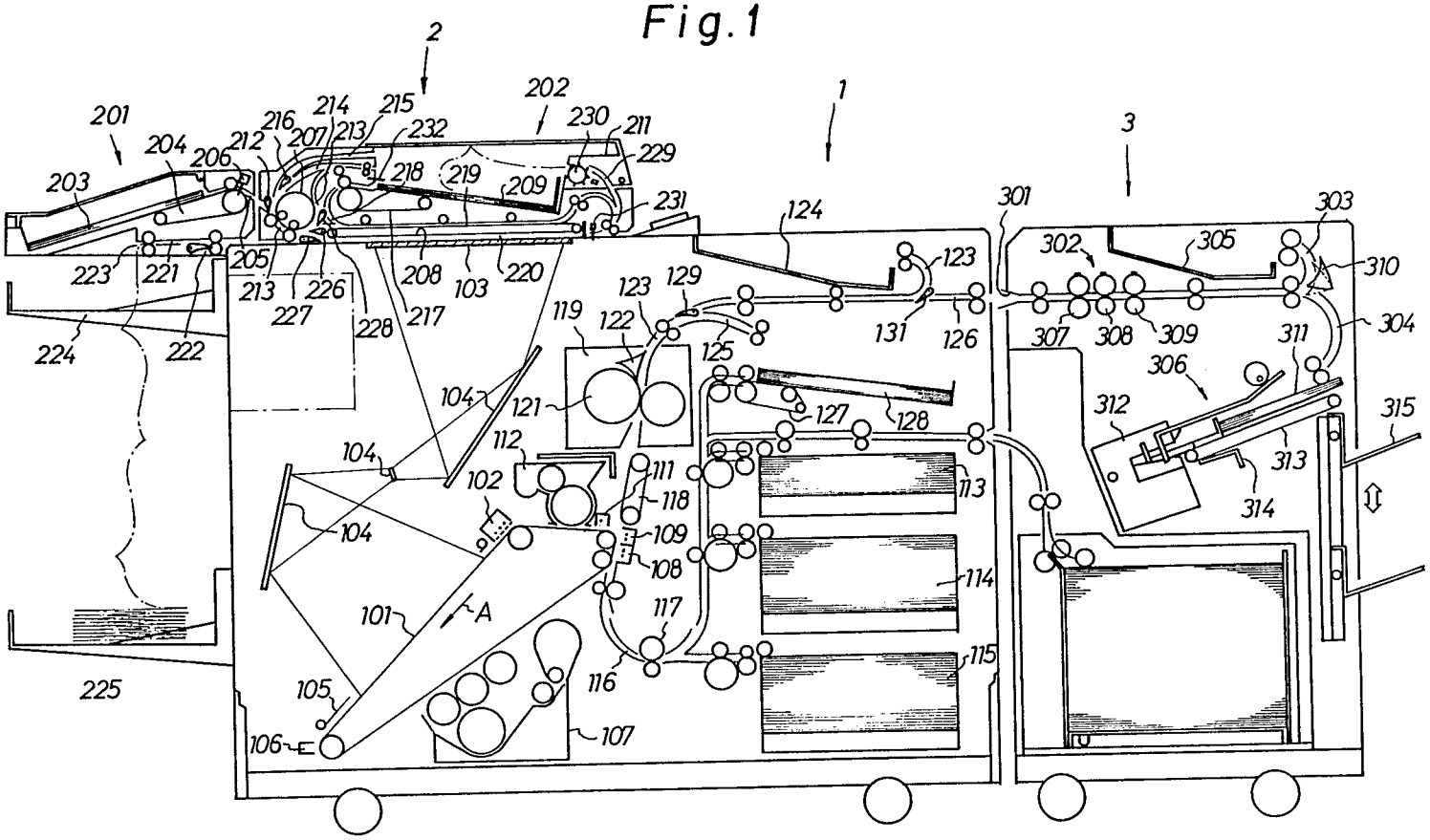
FIG. 1 is an explanatory diagram illustrating the construction of a typical copying machine as one embodiment of the present invention.

Referring now to the drawings, FIG. 1 shows a copier (copying machine) as an embodiment of the present invention. The copier comprises a copying unit 1, an automatic document feeder (automatic original feeding device) 2, and a finisher 3.

Around a photosensitive belt 101 in the copying portion 1 and along the direction toward which the photosensitive belt 101 moves (the direction of the arrow A), there are disposed an electrostatic charger 102 for electrically charging in uniform the photosensitive belt 101, an optical exposure system 104 for exposing an optical image of an original paper laid on a contact glass 103 to the photosensitive belt 101 thereby forming a latent image on the photosensitive belt 101, a regulation plate 105 for preventing unnecessary exposure on the photosensitive belt 101, an eraser 106 for removing electric charge from the non-image region of the photosensitive belt 101, a developer 107 for supplying a toner to the latent image thereby converting the latent image into a toner image, a transfer charger 108 for transferring the toner image onto a transfer paper, a separation charger 109 for separating the transfer paper now bearing the transferred toner image thereon from the photosensitive belt 101, a discharger 111 for relieving the photosensitive belt 101 of residual electric charge, and a cleaning device 112 for removing residual toner from the photosensitive belt 101.

The transfer paper is fed out from one of the three feed trays 113, 114, and 115 and synchronously forwarded through a paper passage 116 by a resist roller 117. The transfer paper on which the toner image was transferred is forwarded through a conveyance tank 118 to fixing device 119 so as to fix the transferred toner image. The fixing device 119 is provided with a fixing roller 121 for heating and pressing the transfer paper and a separation claw 122 for preventing the transfer paper from being wrapped around the fixing roller 121. The leading end of a paper passage 123 extended from the outlet of the fixing device 119 communicates with a discharge tray 124.

The paper passage 123 branches into a paper passage 125 and a paper passage 126. At the extended end of the paper passage 125, an intermediate tray 128 used for double faces copying operation is disposed with a double faces copied paper feeding belt 127. The extended end of the paper passage 126 is connected to the inlet 301 of the finisher 3 mentioned above. At positions where the paper passages 123 and 125 are mutually joined and the paper passages 123 and 126 are similarly joined, switch claws 129 and 131 for selection of continued passages are disposed respectively.

The automatic document feeder 2 is substantially composed of a recycling automatic document feeder (RDF) comprising a first document feeding portion 201 and a second document feeding portion 202 disposed adjacently to each other.

The first document feeding portion 201 has a first original paper tray 203 and a paper feeding belt 204 disposed under the tray 203 at a position near the outlet of the tray 203. The discharge part of the paper feeding belt 204 is connected to the second document feeding portion 202 via an outlet paper passage 205. At a position where the paper feeding belt 204 and the paper passage 205 are interconnected to each other, a sensor group 206 which serves as a code reading device is disposed. The sensor group 206 reads codes, written on a data sheet, for designating the copying condition. The data sheet will be described in detail later.

The second document feeding portion 202 disposed over the contact glass 103 is provided with an original paper reversing part 207 disposed close to the first document feeding portion 201, an intermediate conveyance belt 208 disposed directly above and spaced in parallel with the contact glass 103 by a predetermined distance, a second original paper tray 209 disposed above the intermediate conveyance belt 208, and a continuous paper reversing part 211 disposed behind the second original paper tray 209.

In the inlet portion of the original paper reversing part 207, there is disposed an S-shaped paper passage 213 connected via a guide claw 212 to the outlet paper passage 205 of the first document feeding portion 201. The extended outlet of this paper passage 213 opens into the upper part of the second original paper tray 209. The both end portions of the paper passage 213 are respectively connected to the both ends of an arcuately shaped paper passage 214 which overlies the paper passage 213. Further, directly above the paper passage 214, another paper passage 215 is extended. One end of this paper passage 215 is connected to the midway of the paper passage 214 and the other end thereof opens at a position above the second original paper tray 209. At a position where the paper passage 215 and the paper passage 214 are interconnected to each other, a switch claw 216 serving to permit selection of continued passages is disposed.

A paper feeding belt 217 is disposed under the second original paper tray 209 at a position near the outlet of the tray 209.

The discharge part of the paper feeding belt 217 is connected a paper passage 218 which is semicircularly curved so as to enter the lower part of the second original paper tray 209. The leading end of the paper passage 218 is connected to an intermediate paper passage 219 which is formed in the upper belt portion of the intermediate conveyance belt 208. This intermediate paper passage 219 is reversed again by the continuous paper reversing part 211 disposed behind the second original paper tray 209 and is then connected to an exposure part paper passage 220 formed in the lower belt portion of the intermediate conveyance belt 208. The exposure part paper passage 220 is connected to an original paper discharge passage 221 formed directly below the first original paper feeding portion 201 and, at the same time, outlets 222 and 223 provided for the original paper discharge passage are caused to open respectively above a single original paper discharge tray 224 and a continuous original paper discharge tray 225.

The intermediate paper passage 219 and the exposure part paper passage 220 are connected via switch claws 226 and 227 to intermediate parts of a paper passage 213 disposed in the original paper reversing part 207. Further, directly above the switch claw 226, there is disposed a guide claw 228 adapted to operate so as to permit the original paper in the paper passage 213 to be fed toward the intermediate paper passage 218.

The continuous paper reversing part 211 is further provided with a paper passage 229 for guiding the original paper toward the exposure part paper passage 220. The paper passage 229 is provided in the inlet part thereof with a sprocket 230 for an original paper feeder. At a position where the paper passage 229 and the exposure part paper passage 220 are interconnected to each other, a position sensor group serving to detect the arrival of the leading end of paper is disposed.

Behind the inlet 301 of the finisher 3, which inlet is connected to the outlet paper passage 126 of the copying portion 1, a perforating device 302 is disposed. An upper discharge tray 305 and a stapler 306 are connected respectively to the two paper passages 303 and 304 extended from the perforating device 302. The selection between the paper passages 303 and 304 is effected by the switch claw 310.

Figure 2:
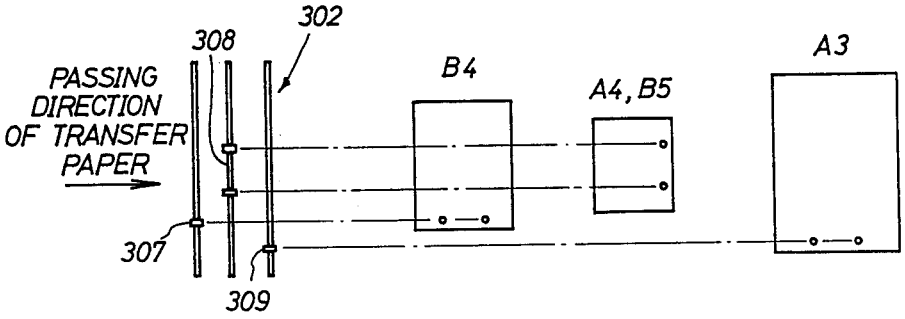
FIG. 2 is a schematic plan view of a perforating device.

The perforating device 302 is intended to perforate a transfer paper discharged from the copying portion 1 by a punching action. As illustrated in FIG. 2, a perforating roller 307 for papers of B4 size, a perforating roller 308 for papers of A4 and B5 sizes, and a perforating roller 309 for papers of A3 size are sequentially disposed in this order in the perforating device 302. The perforation is effected by the perforating device 302 being rotated and caused to generate a punching action by the passage therethrough of the transfer paper. In the case of a paper of B4 size, the perforating roller 307 produces two punching motions. In the case of a paper of A4 size or B5 size, the perforating roller 308 produces one punching motion. In the case of a paper of A3 size, the perforating roller 309 produces two punching motions. The perforated transfer papers are fed through a paper passage 304 to a stapling tray 311 of a stapler 306 which will be described in detail later and stacked in the order of page numbers upwardly from the bottom in the stapling tray 311.

The stapler 306 serves to bind the stacked transfer papers. A stapling device 312 is disposed behind the stapling tray 311 which is connected to the paper passage 304. For the purpose of releasing a stapled set of transfer papers from the copier, a belt 313 to which claws 314 are fixed is disposed. The papers discharged out from the copier are stacked on a discharge tray 315 which can be moved vertically.

Figure 3:
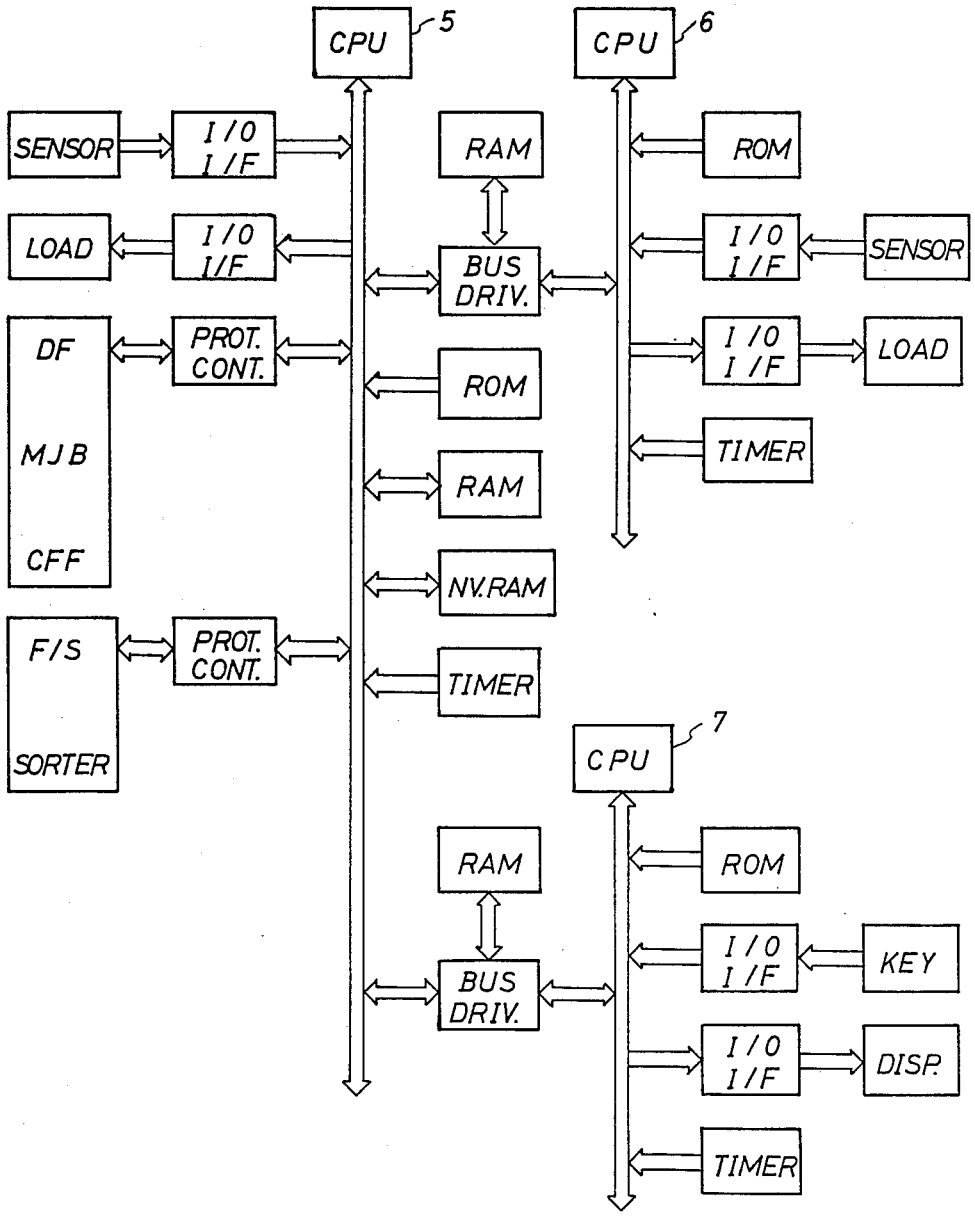
FIG. 3 is a block diagram illustrating a control circuit.

FIG. 3 illustrates a control circuit of the above-mentioned copier. The control circuit has a CPU (central processing unit) 5 for effecting the overall control of the copying operation, a CPU 6 for carrying out the control of paper feeding, and a CPU 7 for carrying out the control of operator console. These CPU's 5, 6, and 7 are respectively composed of multi-CPU systems. Between the CPU 5 and the CPU 6 and between the CPU 5 and the CPU 7, bus drivers (BUS DRIV.) for intercommunication so as to avail the CPU's 5, 6, and 7 of necessary data retrieved from a common read/write memory (RAM).

The CPU 5 is provided with a memory (RAM) required during the overall control of the copying operation, a read-only memory (ROM), a time controlling timer (TIMER), and an involatile memory (NV.RAM) for retaining data. This CPU 5 is connected through input detecting interfaces (I/O, I/F) to various sensor groups, through driving interfaces (I/O, I/F) to various loads (LOAD), and further through protocol controllers (PROT. CONT.) intercommunicably to peripheral devices. The document processing devices to be controlled include a document feeder (DF), a multi-job controller (MJB), a computer form feeder (CFF), etc. The aftertreating devices include a finisher (F/S) and a sorter (SORTER). The finisher is provided therein a perforating unit and a stapling unit.

The CPU 6 and the CPU 7 are formed to serve as sub-CPU's relative to the CPU 5 which functions as a host CPU. The CPU 6 is intended to perform the part of detecting the size and presence/absence of a transfer paper and effecting the control of paper feeding. For this purpose, the CPU 6 is provided with a memory (ROM) necessary for controlling the feed and transfer of a transfer paper and a timer (TIMER) necessary for controlling the relevant motions based on time. The CPU 7 is intended to fulfil the part of detecting the inputs through the keys on the operating console, and displaying the data read out from the memory (ROM). For this purpose, the CPU 7 is provided with a memory (ROM) necessary for storing the data and a timer (TIMER) necessary for effecting the control base on time.

Figure 4:
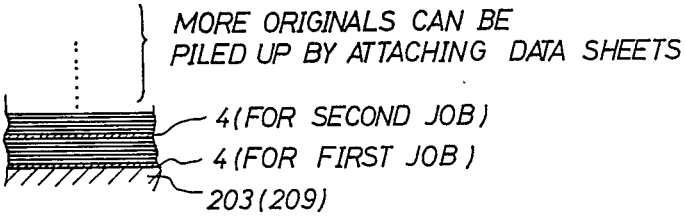
FIG. 4 is an explanatory side view illustrating the stack of original papers.
Figure 5:
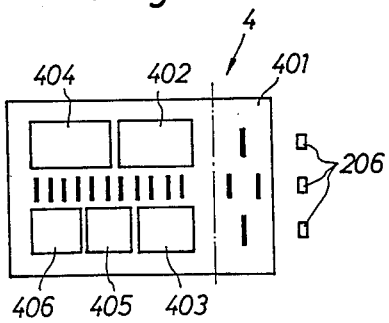
FIG. 5 is an explanatory plan view of a data sheet.
Figure 6:
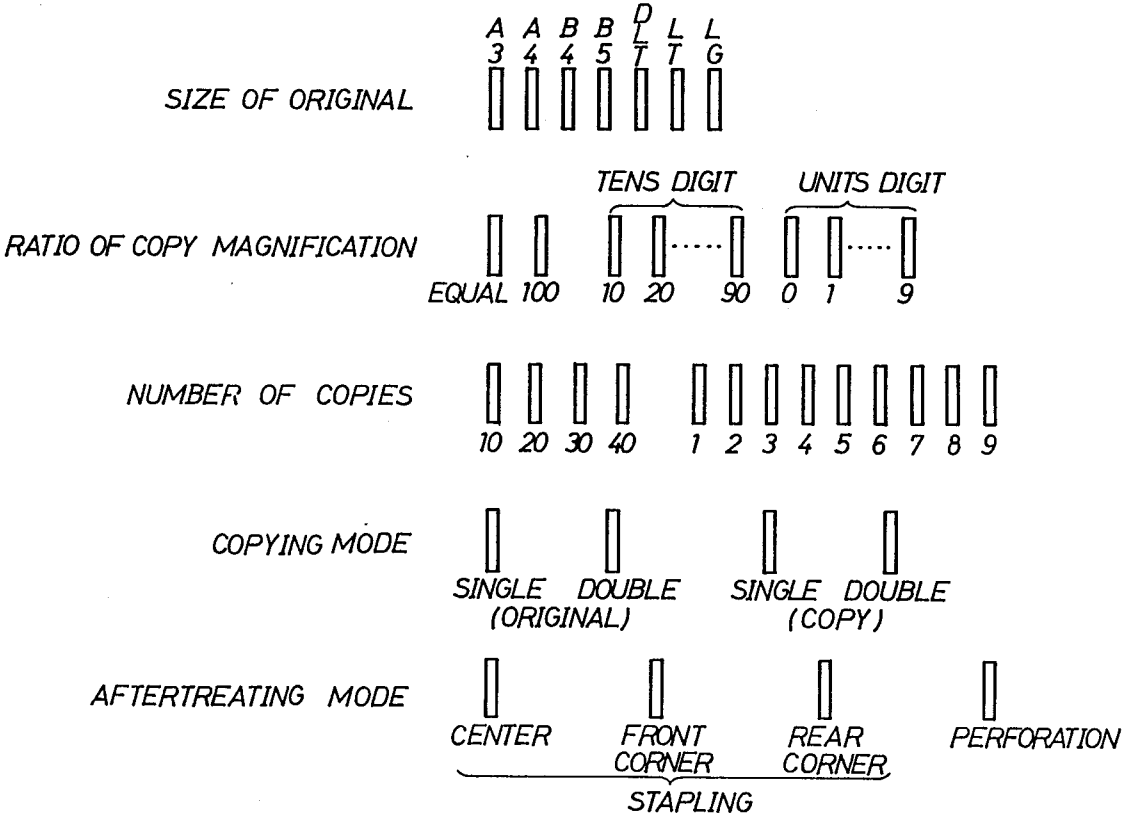
FIG. 6 is a magnified explanatory diagram illustrating marks on the data sheet.

In the copier, a data sheet 4 for designating copying conditions is set at the top of the sequence of original sheets to be fed. Namely, as illustrated in FIG. 4, the data sheet 4 is set in place so as to lead a plurality of original sheets piled up in the order to suit a given set of copying conditions. Each data sheet 4 indicates a start of a new job. The codes for designating copying conditions written in the data sheet are formed by an arrangement of marks as shown in FIG. 5. Namely, at the front of the data sheet, a job sheet key mark 401 for identification of the sheet itself to be a data sheet is arranged. Behind the mark 401, a mark 402 for indicating the size of an original sheet, a mark 403 for indicating the number of copies to be produced, a mark 404 for indicating the ratio of copy magnification, a mark 405 for designating the selection between the single faced and double-faced copying modes, and a mark 406 for indicating the aftertreating mode of stapling and perforating works are arranged. The marks are formed by the pattern of a mark sheet as illustrated in FIG. 6. The marks stained in black are detected by the sensor group 206 serving a code reading device, thus the copier receives a designation of the copying conditions.

The copier constructed as in the present embodiment is capable of carrying out various copying operations corresponding to copying modes such as the single face copying mode, the double faces copying mode, the ADF copying mode, the RDF copying mode, the RADF copying mode, and the combination of the above mentioned copying modes. By having a plurality of sets of original papers piled up with data sheets 4 inserted each in the top of the individual set, the copier is enabled to perform a copying operation of the multi-job mode in which specific copying operations are carried out severally on the successive sets of original papers under respectively specified copying conditions. In this case, the copying conditions for original papers can be set either simultaneously or severally during copying operation by having the plurality of sets of original papers superposed in the corresponding order.

In the ordinary single face copying mode, the transfer papers which have undergone the step of fixing are forwarded through the paper passage 123 and sequentially discharged into the discharge tray 124 with the single copied surfaces held on the under side. The discharge switch claw 131 is turned that the transfer papers are discharged into the finisher 3 when desired.

In the case of the double faces copying mode, the double faces switch claw 129 is turned so that the transfer papers which have undergone the step of fixing are forwarded through the paper passage 125 and sequentially discharged into the double faces tray 128 with the copied surfaces held on the upper side. The transfer papers which have been received in the double faces tray 128 are sequentially conveyed again by the paper feeding belt 127 to the transfer portion upwardly from the bottom to get copies on the another surfaces and, thereafter, discharged onto the discharge tray 124 or into the finisher 3.

In the case of the ADF mode, the original papers are automatically fed sequentially. The original papers which are set in the first original paper tray 203 of the first document feeding portion 201 are fed out sequentially by the paper feeding belt 204 upwardly from the bottom, passed through the outlet paper passage 205, then introduced into the paper passage 213 with the guide claw 212 of the second original paper feeding portion 202 pushed upwardly, and finally piled up in the second original paper tray 209. The original papers which have been piled up in the second original paper tray 209 are fed out sequentially by the paper feeding belt 217 upwardly from the bottom, passed through the paper passage 218, and introduced into the intermediate paper passage 219. Then, the original papers are fed by the intermediate conveyance belt 208 to the document table on the contact glass 103 so as to be subjected to necessary exposure. After exposing operation, the original papers are fed out from the contact glass 103, passing under the branch claw 227 and through the paper passage 221, guided by the switch claw 227 set in advance to a desired direction, onto the discharge tray 224 through the outlet 222. This ADF mode fits a copier provided with a sorter as an aftertreating device.

In the case of the RDF mode, the original papers are exposed to light once in one cycle. This cycle is repeated by a desired number of times as to produce the desired number of sets of copies. To be specific, the original papers set in the first original paper tray 203 of the first document feeding portion 201 are invariably forwarded through the same route as in the ADF mode described above until the first cycle of exposure is completed. After the exposing operation, the original paper, however, is picked up from the contact glass 103, forwarded to the paper passage 213 by the switch claw 227, and then fed into the paper passage 215 by the switch claw 216. In this case, when the rear end of an original paper passes the switch claw 226, the conveyance drive sources begin to inversely rotate and thus the original paper is fe into the paper passage 213, with the former rear end of the paper now in the front. The original paper are then, via the discharge open, stacked again on the second original paper tray 209. In this case, the original papers are set on the second original paper tray 209 in the same direction as before the exposure. Since the original papers before the exposing operation and the original papers after the exposing operation are clearly separated by a partitioning member 232 can be selectively advanced or retracted, completion of a cycle of exposure can be easily discerned. A desired number of sets of copies can be obtained by repeating this cycle as many times as required.

When double faces original papers are to be treated by the ADF mode, the original papers set in the second original paper tray 209 of the second document feeding portion 202 are fed without exposing operation and then stacked again in the second original paper tray 209 causing the original paper reversed. The passage necessary for this operation are formed by the intermediate paper passage 219 the surface of the contact glass 103, and the paper passages 213 and 214 connected to the second original paper tray 209. The original papers thus stacked in the second original paper tray 209 are fed through the same paper passages as those of the aformentioned to the position for exposure. After exposing operation, the original papers are fed through the paper passage 213 into the paper passage 215. When the rear end of an original paper passes the switch claw 226, the conveyance drive sources begin to inversely rotate and feed the original papers backward, with the former rear end of the papers now in the front. In this case, the original papers are fed to the intermediate paper passage 219 by the action of the guide claw 228 and then placed on the contact glass 103 so that the another surfaces are subjected to necessary exposure. After the exposing operation, the original papers are discharged onto the discharge tray 224. Double faces copies can be obtained by performing the above-mentioned operation with respect to each of the original papers.

When double faces original papers are treated in the RDF mode, the original papers set in the second original paper tray 209 of the second document feeding portion 202 are fed via the intermediate paper passage 219 to the exposure position on the contact glass 103 so as to be subjected to exposure. Then, the original papers are passed through the paper passages 213 and 214 and stacked again in the second original paper tray 209. In the tray 209, the original papers are inversely piled up in contrast with that before the exposure. Namely, the copied surfaces are upward. Then, the original papers are fed through the same routes as mentioned above to the position where the another surfaces are exposed to light and then returned through the aforementioned passages into the second original paper tray 209. By the two circulations of the original papers, a set of copy papers each bearing copies on both sides can be obtained. The original papers which are stacked after the second circulation are set in the same direction as the direction they were initially set in the second original paper tray 209. By taking the two circulations as one cycle and repeating this cycle as many times as required, a desired number of sets of double faces copies can be obtained from the given double faces original papers.

As described above, the copier according to this embodiment can carry out copying operations not merely of the ADF mode in which a plurality of copies are obtained at the same time from one original paper but also of the RADF mode in which a plurality of sets of copies arranged in the order of page numbers are obtained by producing one copy from each of the original papers and repeating this cycle successively on all the original papers. This RADF mode fits a copier to which, as in the embodiment, a finisher serving as an aftertreating device is connected.

Now the multi-job mode will be described below. This multi-job mode permits, even while a copying operation under a certain copying condition is in progress, a plurality of sets of original papers intended for copying under different copying conditions to be set. The copying operations under different copying conditions are performed successively by changing the copying conditions when each of the jobs finishes.

First, when one set of original papers is stacked in the first original paper tray 203 of the first document feeding portion 201, a data sheet 4 having a given copying condition is set at a top (lower most position) of the sequence of original papers so that the data sheet 4 is first fed out. When a plurality of sets of original papers are to be set in the first original paper tray 203, they are piled up sequentially with data sheets 4 inserted each of the top of the sets of original papers. The feeding of the original papers is started by a feeding start signal. First the data sheet 4 is fed to the sensor group 206, where the copying condition is read out. Based on the data thus read out, the operation mode of the copier is determined.

The second original paper tray 209 of the second document feeding portion 202 is adjusted to match the dimensions of the original paper to be copied. Then, the data sheet 4 is fed through the paper passage 213 for the ADF mode and the intermediate paper passage 219, passed over the contact glass 103 without exposing operation, and fed through the paper passage 221 and the paper discharge opens 222 and 223 to the discharge tray 224. The original papers following the data sheet 4 are fed through the paper passage 213 to the second original paper tray 209 and stacked thereon. As a result, the copier is ready for a copying operation in the ADF mode or the RDF mode. Thereafter, the copying operation is executed. After the copying operation is completed, all the original papers are discharged on the discharge tray 224 and, at the same time, the copier is prepared for the next job. At this time, the last of the set of original papers forwarded from the first original paper tray 203 is followed by the data sheet 4 of the subsequent set of original papers. When the arrival of this new data sheet 4 is detected, the next job is judged and the data sheet 4 is fed to the discharge tray 224 in the first document feeding portion 201 as the same manner as that mentioned above.

Figure 7:
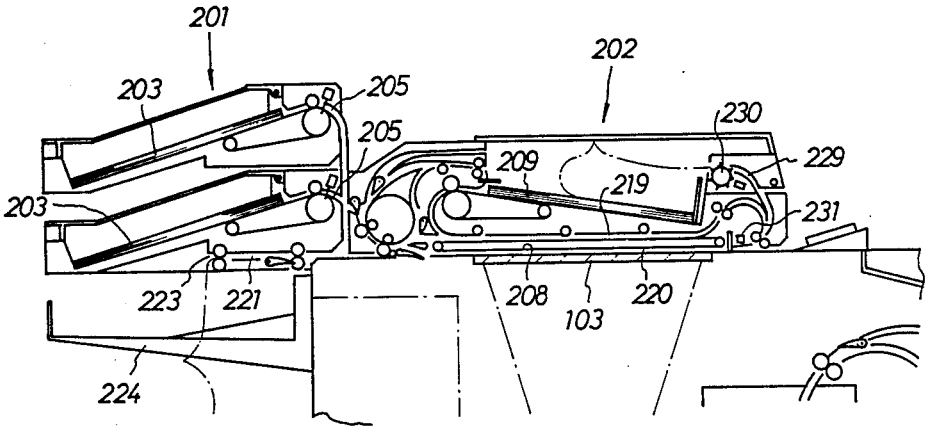
FIG. 7 is a schematic explanatory diagram illustrating another typical automatic original paper feeding device.

As shown in FIG. 7, the first document feeding portion 201 can be constructed by double trays 203 which will be convenient to set more different kinds of jobs in advance.

Now, the copy mode for handling an original of a continuous strip of paper as for computer output will be described below. A continuous strip of paper formed by alternately folding a continuous sheet of paper is set in the second original paper tray 202 and positioned by an end plate and a side plate. As a result, the length of one fold sheet of the paper is detected and the number of feeding perforations is judged. The number of perforations thus read out is used as the standard feeding length of one page of paper.

The upper end of the paper is set in the sprocket for the original paper feeder. When a feed signal is issued, the paper is forwarded through the paper passage 229 onto the contact glass 103. When the position sensor group 231 detects the arrival of the leading end of the paper, the paper is advanced further by a distance determined by the relation between the original paper setting position and the number of perforations. Then the paper is stopped at the exposure position to do a copying operation. Then, the sprocket 230 advances the paper by the number of perforations equal to one page of paper, to produce a copy each in the subsequent pages of paper. The original paper after the copying operation is fed through the paper passage 221 and the discharge open 223 to the discharge tray 225 and stacked in a molded manner on the discharge tray 225. The feeding of the continuous strip of paper is obtained in two modes, one mode is page-to-page blank feeding and the other mode is continuous blank feeding. By means of a selection key, these two modes can be freely selected.

Figure 8:
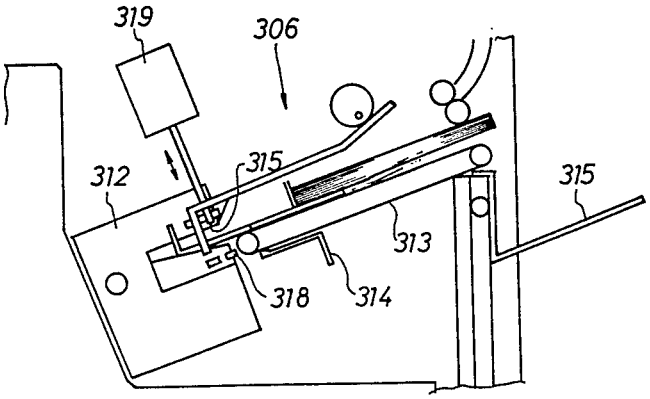
FIG. 8 is a schematic explanatory diagram illustrating another typical stapler.

Optionally, an integral punch unit 319 comprising a punch 317 and a die 318 is disposed in close juxtaposition to a stapler 306 as illustrated in FIG. 8 so that the step of perforation may be carried out simultaneously with or subsequently to the step of stapling. This arrangement offers a perfect solution to a possible problem of misalignment of perforations in a stapled set of pages.

Many widely different embodiments of the present invention may be constructed without departing from the spirit and scope of the present invention. It should be understood that the present invention is not limited to the specific embodiments described in this specification, except as defined in the appended claims.

What is claimed is:

1. A method of controlling copying operation of a copying machine provided with a copying means for performing a copying operation, a feeding means for sequentially feeding a plurality of original papers to be copied to said copying means, and first and second trays, said copying machine capable of carrying out a plurality of copying operation modes, said method comprising the steps of:

inputting information of at least one desired copying operation mode in at least one data sheet;

stacking said data sheet and the original papers to be copied in said first tray;

detecting information in said data sheet fed from said first tray by means of said feeding means before the original papers;

temporarily stacking only the original papers to be processed under said desired copying operation mode, in said second tray; and in response to the information detected from said data sheet, selectively carrying out a copying operation of said desired copying operation mode with regard to said original papers stacked in said second tray.

2. A method as claimed in claim 1, wherein said method further comprises a step of discharging said data sheet from said copying machine without stacking it in said second tray.

3. A method as claimed in claim 1, wherein said data sheet has an identifier for discriminating a data sheet from original papers, and wherein said detecting step comprises a step of detecting the identifier in said data sheet.

4. A method as claimed in claim 3, wherein said discharging step comprises a step of discharging the data sheet from said copying machine without stacking it in said second tray when said identifier is detected in said detecting step.

5. A method as claimed in claim 1, wherein said inputting step comprises a step of writing information of a desired copying operating mode in the form of mark sheet codes on a data sheet.

6. A method as claimed in claim 1, wherein said stacking step comprises a step of arranging said data sheet under the stacked original papers so that said data sheet is first fed out from the first tray.

7. A copying machine provided with a copying means for performing a copying operation and a feeding means for sequentially feeding a plurality of original papers to be copied to said copying means, said copying machine capable to carrying out a plurality of copying operation modes, comprising:

a first tray for stacking at least one data sheet and the original papers to be copied;

a first means for detecting information inputted in the data sheet fed from said first tray by means of said feeding means before the original papers;

a second tray for temporarily stacking only the original papers to be processed under said desired copying operation mode; and a second means for, in response to the information detected from said data sheet, selectively carrying out a copying operation of a desired copying operation mode which is designated by said detected information, said copying operation being carried out with regard to said original papers stacked in said second tray.

8. A machine as claimed in claim 7, wherein said feeding means comprises means for discharging said data sheet from the copying machine without stacking in said second tray.

9. An apparatus as claimed in claim 7, wherein said data sheet has an identifier for discriminating a data sheet from original papers, and wherein said first means comprises means for detecting the identifier in said data sheet.

10. A machine as claimed in claim 9, wherein said feeding means comprises means for discharging said data sheet from the copying machine without stacking in said second tray when said identifier is detected by said first means.

* * * * *